United States Patent [19]

Jackisch

[11] 4,391,233

[45] Jul. 5, 1983

[54] INTERNAL-COMBUSTION ENGINE

[76] Inventor: Rudolph Jackisch, 3927 N. Elston Ave., Chicago, Ill. 60618

[21] Appl. No.: 250,874

[22] Filed: Apr. 3, 1981

[51] Int. Cl.[3] ..... F02B 75/16

[52] U.S. Cl. ..... 123/61 R; 123/70 R; 123/53 B

[58] Field of Search ..... 123/61 R, 61 V, 70 R, 123/70 V, 53 R, 53 B, 78 E

[56] References Cited

U.S. PATENT DOCUMENTS

| | | | |
|---|---|---|---|
| 3,386,425 | 6/1968 | Morsell | 123/61 R |
| 4,111,164 | 9/1978 | Wuerfel | 123/78 E |

FOREIGN PATENT DOCUMENTS

| | | | |
|---|---|---|---|
| 711136 | 9/1941 | Fed. Rep. of Germany | 123/53 B |
| 884712 | 7/1953 | Fed. Rep. of Germany | 123/61 R |
| 553334 | 5/1923 | France | 123/53 B |

*Primary Examiner*—Craig R. Feinberg
*Attorney, Agent, or Firm*—Becker & Becker, Inc.

[57] ABSTRACT

An internal combustion engine having at least one working cylinder which has a combustion chamber, a working piston which is connected to a crankshaft, and an inlet nozzle for the supply of fuel. Associated with the working cylinder is an auxiliary cylinder having an auxiliary chamber and an auxiliary piston which moves back and forth and is forcibly controlled in the working cycle of the working piston. The auxiliary piston compresses preferably precompressed combustion air to the compression pressure necessary for spontaneous ignition. The auxiliary chamber is constantly in open communication with the combustion chamber by means of an intermediate space during the entire working cycle of the engine. The inlet nozzle for the supply of fuel opens into the intermediate space, and the inlet nozzle is controlled in the working cycle of the auxiliary piston.

13 Claims, 10 Drawing Figures

INTERNAL-COMBUSTION ENGINE

Figures 1, 1A, 1B:
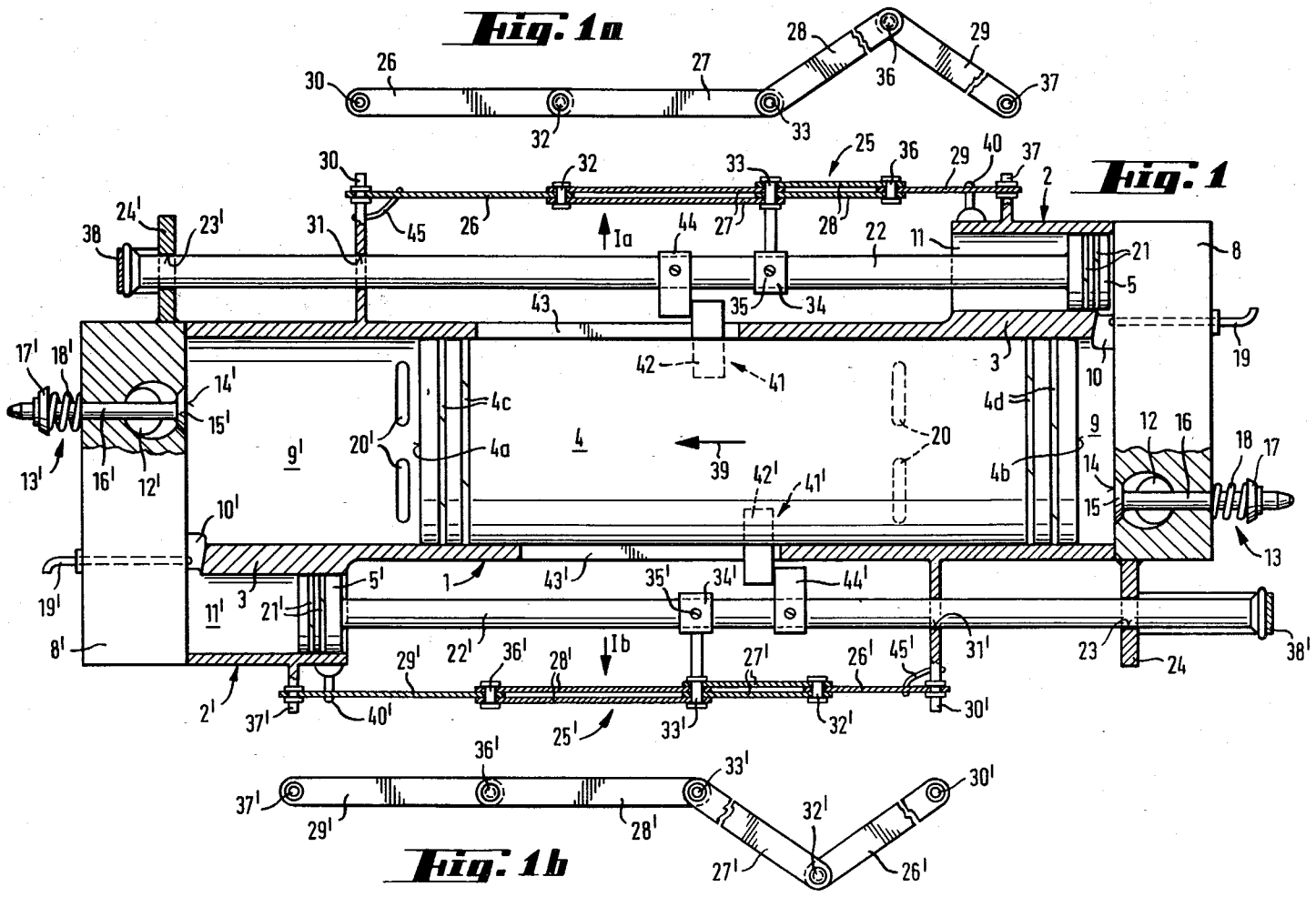

The invention relates to an internal-combustion engine, preferably a two-stroke diesel engine, with at least one working cylinder which has a combustion chamber and a working piston and the working piston of which is connected to a crankshaft, and with an inlet nozzle for the supply of fuel.

The invention is intended to provide an internal-combustion engine which permits a better turbulence and utilization of the fuel, without the fuel-injection pump which is conventional in these engines being necessary. Furthermore, the fuel consumption of the engine is to be reduced.

This object is achieved, according to the invention, due to the fact that there is assigned to the working cylinder an auxiliary cylinder with an auxiliary chamber and with an auxiliary piston which moves to and fro and is forcibly controlled in the working cycle of the working piston and which preferably compresses precompressed combustion air to the compression pressure necessary for spontaneous ignition, that the auxiliary chamber is constantly in open communication with the combustion chamber via an intermediate space, during the entire working cycle of the engine, that the inlet nozzle for the supply of fuel opens into the intermediate space and that the inlet nozzle is controlled in the working cycle of the auxiliary piston.

During the compression stroke of the working piston, the combustion air located in the working chamber is pressed out of the working chamber via the intermediate space into the auxiliary chamber and is compressed according to the stroke of the working piston. The auxiliary piston is forcibly controlled by the working piston in such a way that the auxiliary piston executes its compression stroke after the precompression of the combustion air by the working piston. During the compression stroke of the auxiliary piston, the combustion air is then pressed out of the auxiliary chamber through the intermediate space into the working chamber. Simultaneously with the compression stroke of the auxiliary piston, the inlet nozzle is also forcibly controlled so that the fuel flows into the intermediate space during the compression stroke. As a result of the compression of the combustion air by the auxiliary piston, a strong flow prevails in the intermediate space, so that the fuel is entrained out of the inlet nozzle opening into the intermediate space and is atomized very finely as a result of the high velocity of flow. The auxiliary piston compresses to the final compression pressure the combustion air which has already been precompressed by the working piston. The strong flow of the combustion air as a result of the compression stroke of the auxiliary piston leads to a strong and intensive turbulence, so that the fuel is burnt completely.

Further features of the invention emerge from the description, the claims and the drawings.

Figures 2, 2A, 2B:
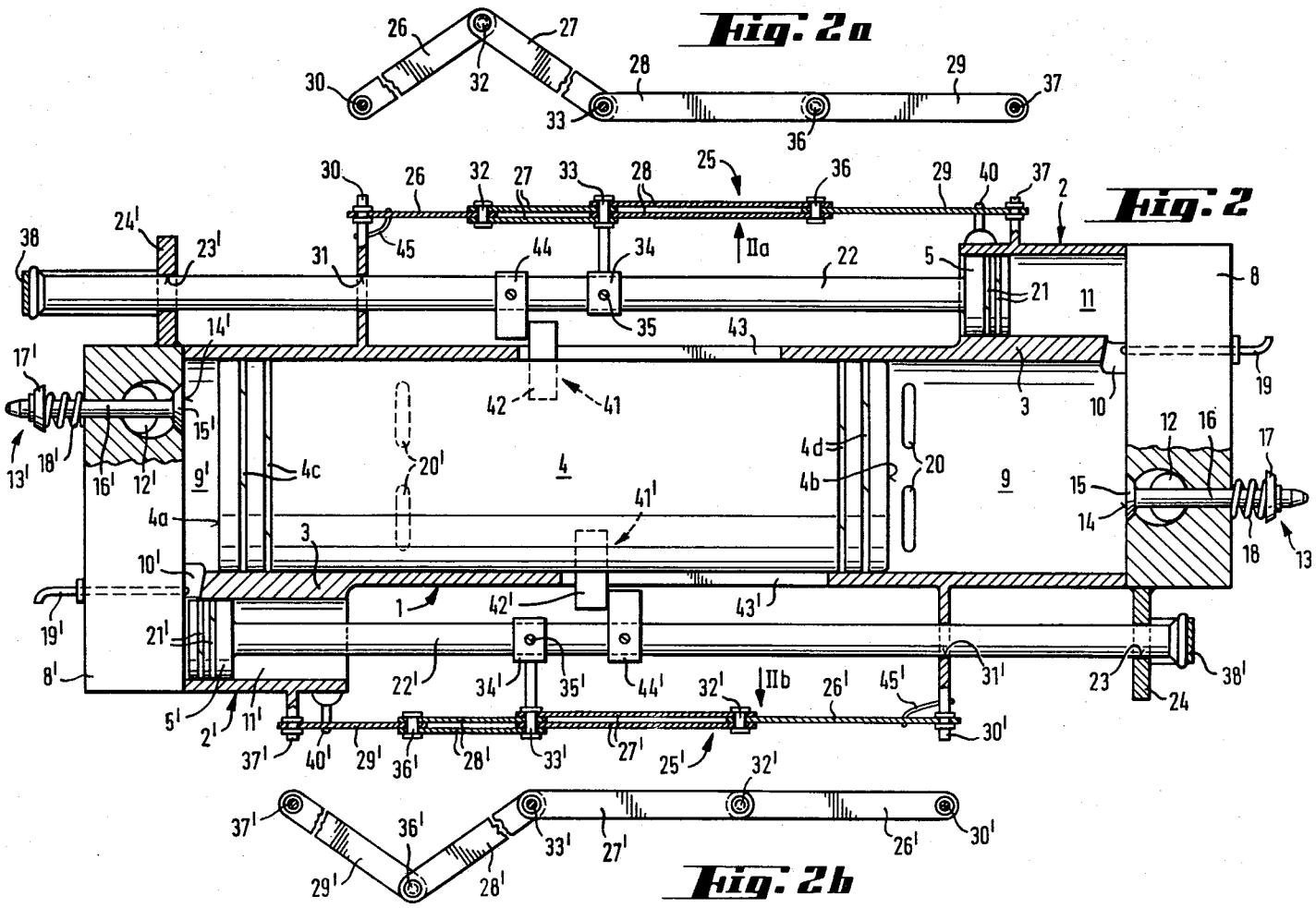
Figure 3:
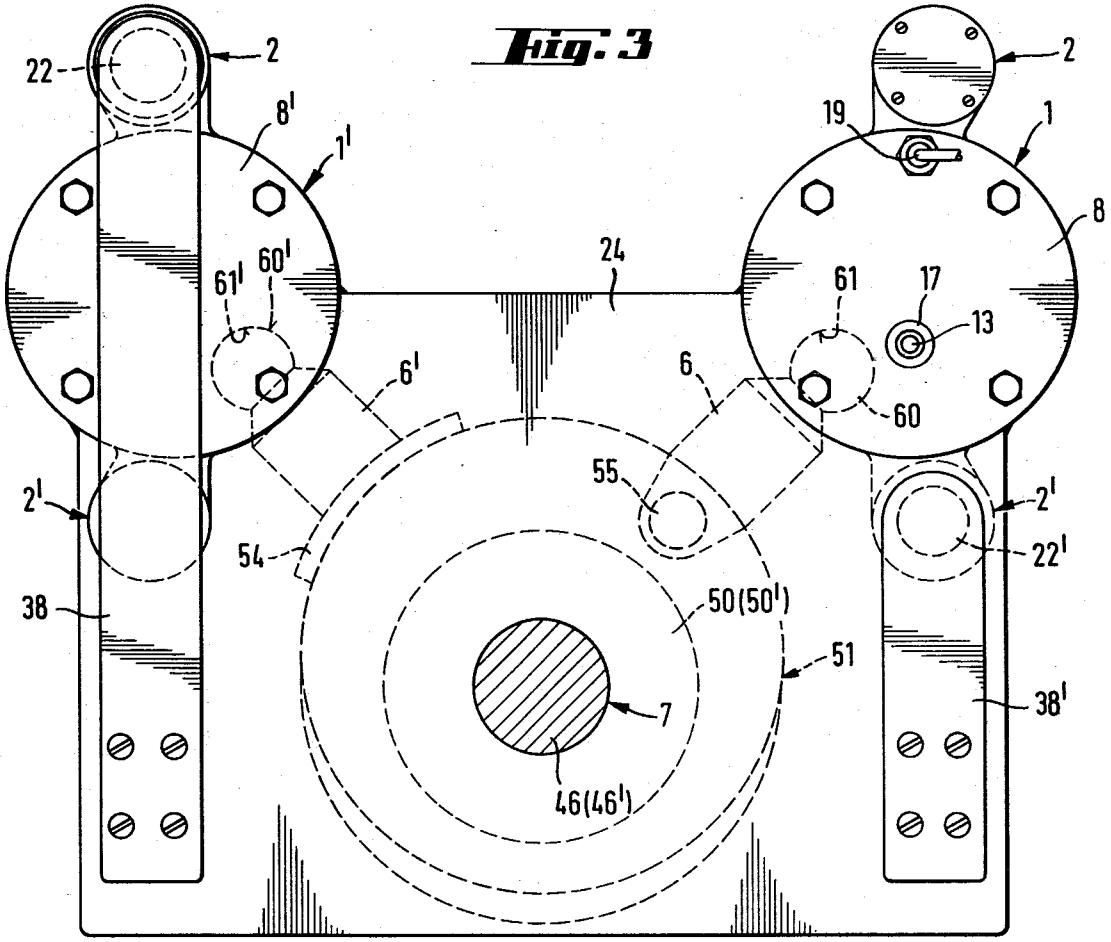
Figure 4:
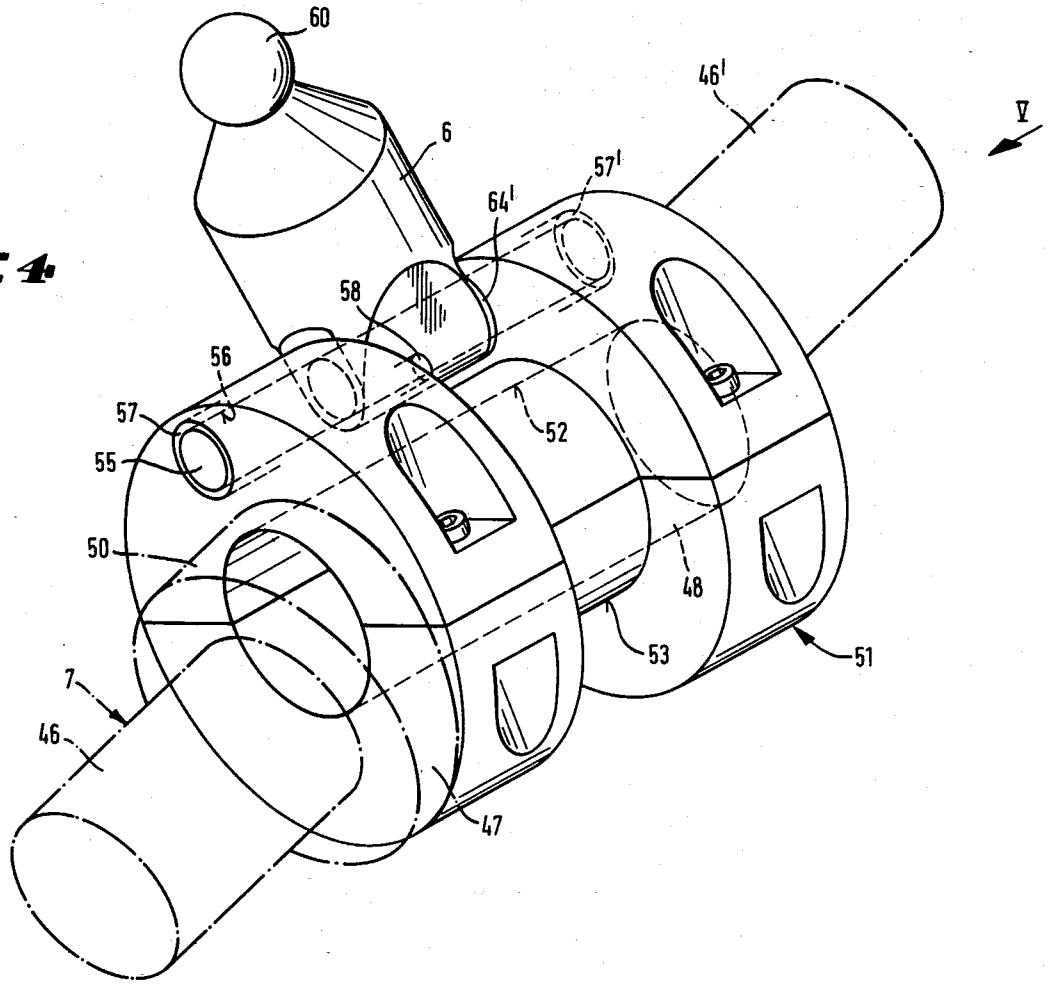
Figure 5:
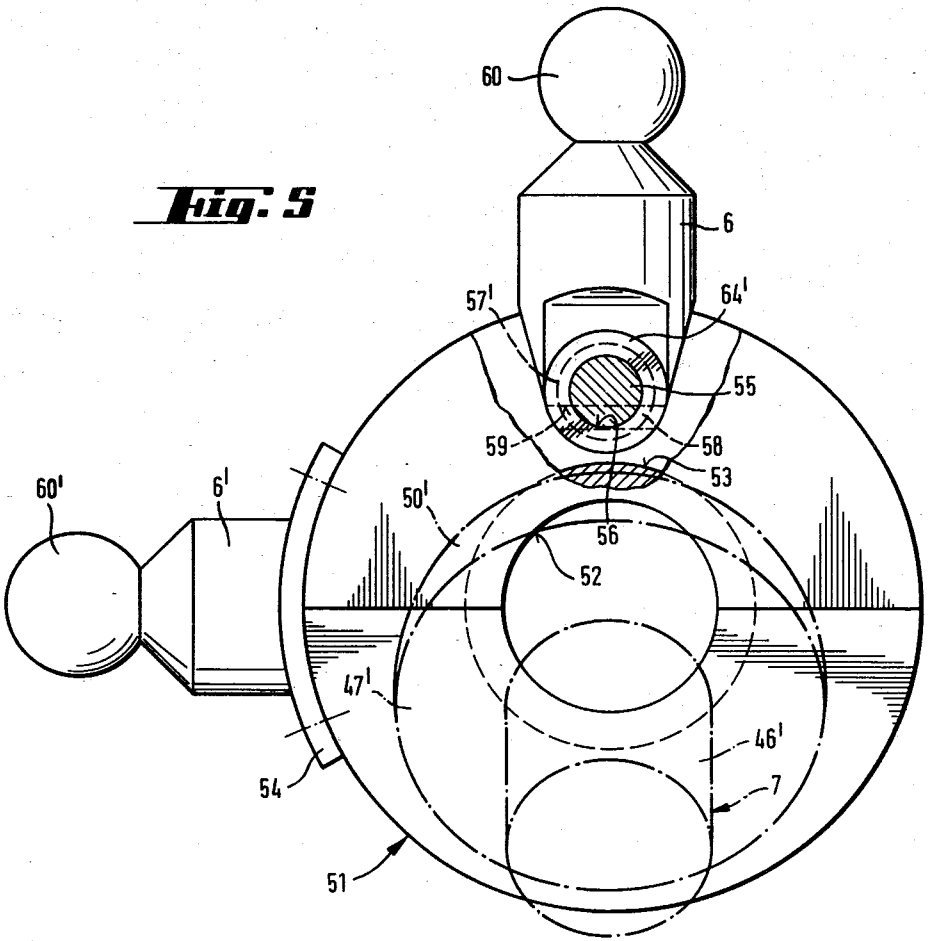
Figure 6:
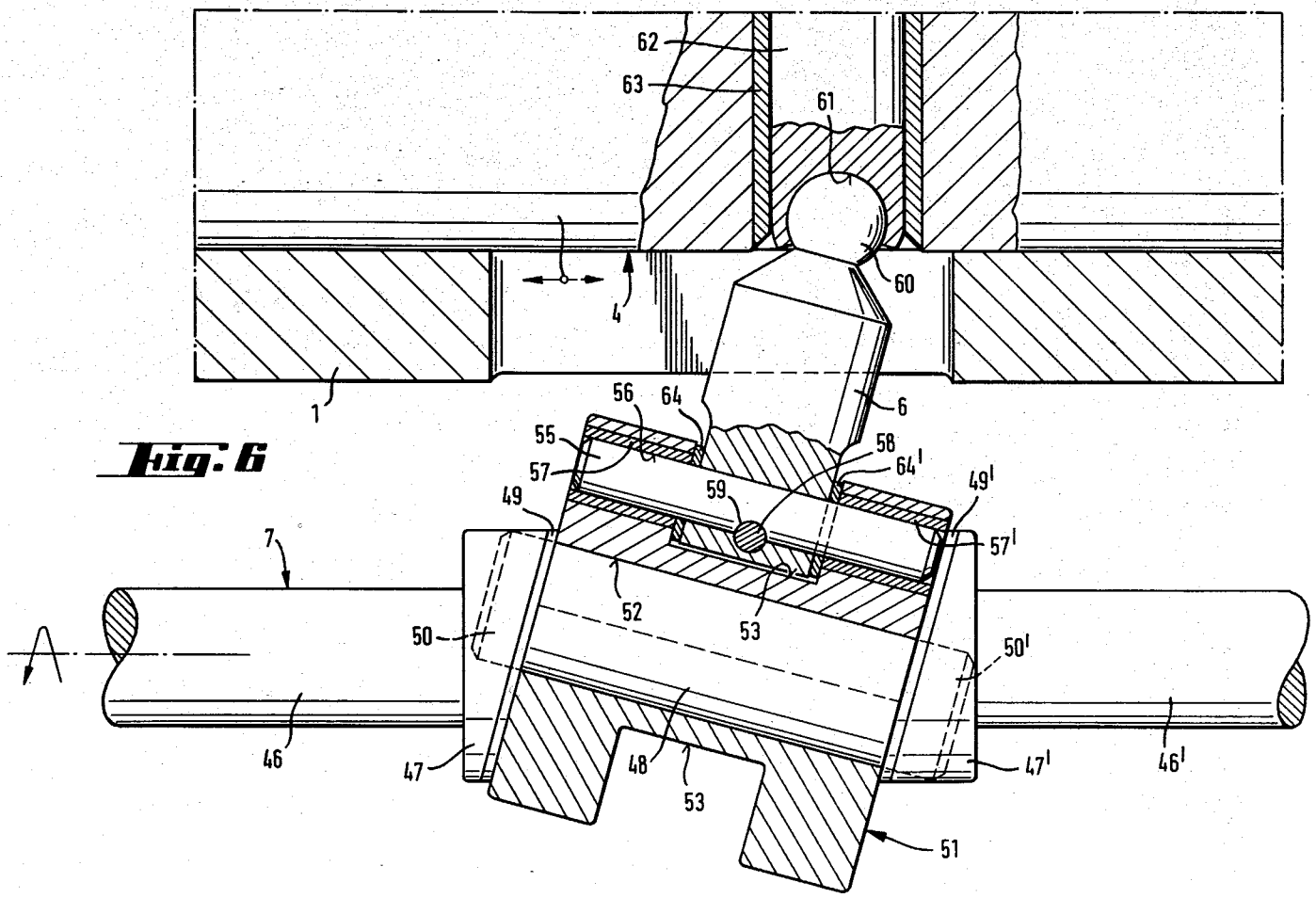

The invention is explained in more detail with reference to an exemplary embodiment illustrated in the drawings in which:

FIG. 1 shows in an axial section the internal-combustion engine according to the invention which is designed as a two-stroke engine with a double cylinder arrangement, and in which the upper auxiliary piston of the upper auxiliary cylinder assumes its top dead-center position and the auxiliary piston of the lower auxiliary cylinder assumes its bottom dead-center position, the position of toggle-lever linkages controlling the auxiliary pistons being illustrated separately in FIGS. 1*a* and 1*b*, FIG. 2 shows, in a representation corresponding to FIG. 1, the internal-combustion engine in a position in which the upper auxiliary piston now assumes the bottom dead-center position and the lower auxiliary piston assumes the top dead-center position, the position of the toggle-lever linkages being illustrated separately, FIG. 3 shows a rear view of the internal-combustion engine according to the invention, according to FIGS. 1 and 2, FIG. 4 shows, in a perspective representation, a mounting for a crank arm of a working cylinder of the internal-combustion engine according to FIGS. 1 to 3, on an enlarged scale, FIG. 5 shows a view in the direction of the arrow V in FIG. 4, FIG. 6 shows a part of the crankshaft of the internal-combustion engine according to the invention, with the bearing according to FIGS. 4 and 5 and the connection of the bearing to the working piston via a crank arm.

The internal-combustion engine has a working cylinder 1 and two auxiliary cylinders 2,2' which are separated from the working cylinder 1 by an intermediate wall 3. The auxiliary cylinders 2,2' extend only over a part of the axial length of the working cylinder 1. In the region of the auxiliary cylinders 2,2', the intermediate wall 3 is thickened so that it can absorb the forces which arise during combustion of the fuel. Mounted so as to move to and fro are a working piston 4 in the working cylinder 1 and an auxiliary piston 5,5' in each of the auxiliary cylinders 2,2'. The working piston 4 is designed as an elongate cylindrical body which has on each of its two end faces a piston end plate 4*a*,4*b* and piston rings 4*c*, 4*d*.

The internal-combustion engine illustrated in the drawings has two working cylinders 1,1' each with two auxiliary cylinders 2,2' (FIG. 3). The two working cylinders have an identical design, so that only the one working cylinder will be described below.

The working piston 4 is connected by a crank arm 6 (FIG. 6) to a crankshaft 7 which, during its rotary movement, moves the working piston 4 to and fro via the crank arm 6. The working cylinder 1 and the two auxiliary cylinders 2,2' are each closed by a cylinder head 8,8'. The two cylinder heads each delimit, together with the piston end plates 4*a*,4*b* of the working piston 4, a combustion chamber 9,9' which is connected to an auxiliary chamber 11,11' via an intermediate space 10,10'. The intermediate space 10,10' is located between the cylinder head 8,8' and the intermediate wall 3, while the auxiliary chamber 11,11' is located between the cylinder head and the auxiliary piston 5,5'.

The working cylinder 1 and the auxiliary cylinders 2,2' are made in one piece. An air inlet channel 12,12' which is connected to a compressor opens into the cylinder covers 8,8'. Provided within the cylinder head 8,8' is a combustion-air collecting chamber which is closed off from the combustion chamber 9,9' by a valve 13,13'. Provided in that side of the cylinder head 8,8' which faces the combustion chamber 9,9' is an air outlet opening 14,14' which is closed by a valve disc 15,15' of the valve 13,13'. A valve tappet 16,16' projects out of the cylinder head 8,8' and carries at its free end a stop 17,17' for a compression spring 18,18' which is supported with its other end on the cylinder cover. The valve disc 15,15' is held in its closing position under the force of the compression spring. The two valves 13,13' are forcibly controlled via the crankshaft 7. For this purpose, there is mounted on the crankshaft 7 a cam (not shown) which is connected to the valve tappet 17,17' via linkage (not shown) in such a way that, via the linkage, the valve 13,13' is moved into its opening position against the force of the compression spring 18,18'. After a given inlet period for the combustion air, the valve tappet is released by the linkage as a result of the cam control, so that the compression spring closes the valve again via the stop 17,17'.

Furthermore, provided in the two cylinder heads 8,8' is an inlet nozzle 19,19' for the fuel, which is connected to a fuel pump via a force-control (not shown). Fuel is fed into the cylinder via the force-control in the working cycle of the internal-combustion engine. The inlet nozzle 19,19' opens into the intermediate space 10,10' between the intermediate wall 3 and the cylinder head 8,8'.

Slit-shaped outlet openings 20,20' for the outflow of the combustion gases are provided, at a distance from the cylinder head 8,8', in the shell of the working cylinder 1.

The auxiliary cylinders 2,2' are open at the ends facing away from the associated cylinder covers 8,8'. The auxiliary chamber 11,11' of the auxiliary cylinders is sealed off from the outside by means of piston rings 21,21' of the auxiliary pistons 5,5'. Fastened to the underside of each of the auxiliary pistons 5,5' is a piston rod 22,22' which is led out from the auxiliary cylinder 2,2'. The axes of the piston rods and the axis of the working piston 4 are parallel to one another. In the region of their free ends, the piston rods 22,22' are each guided in an opening 23,23' of a plate 24,24' which runs transversely to the axis of the cylinders 1,2,2' and which is fastened to the working cylinder 1.

The auxiliary pistons 5,5' are forcibly controlled in the working cycle of the internal-combustion engine via the piston rods 22,22'. Drive means 25,25' which engage on the piston rods are provided for the force-control. In the exemplary embodiment, the drive means consist of toggle levers which have toggle-lever arms 26 to 29, 26' to 29' which are hinged to one another. The toggle-lever arms 26,29 and 26',29' respectively at the ends each consist of only a single arm, whereas the toggle-lever arms 27,28 and 27',28' respectively which are located between them are each present in pairs (FIG. 1). The toggle-lever arm 26,26' sits pivotably on a bearing or support part 30,30' which is connected fixedly to the working cylinder 1 and which has an opening 31,31' to permit the passage of the piston rods 22,22'. As a result of this double mounting of each piston rod, a very secure guidance of the piston rods is achieved.

The toggle-lever arm 26,26' is connected via a hinge pin 32,32' to the two toggle-lever arms 27,27', between the ends of which is located the adjacent end of the toggle-lever arm 26. The other ends of the toggle-lever arms 27,27' and the adjacent ends of the further toggle-lever arms 28,28' sit on a common bearing pin 33,33' which is provided on an adjusting ring 34,34' mounted on the piston rods 22,22'. The adjusting ring can be clamped on the piston rods 22,22', in the particular position desired, by means of a clamping screw 35,35'. The two toggle-lever arms 28,28' are hinged via a further hinge pin 36,36' to the toggle-lever arm 29,29' at the end, the other end of which sits pivotably on a peg-shaped bearing or support part 37,37' which is provided on the auxiliary cylinder 2,2', preferably made in one piece with the latter. The toggle-lever arms are secured against displacement on the bearing parts 30,30', 37,37' and on the hinge pins 32,32', 33,33', 36,36'.

The auxiliary pistons 5,5' stand under the force of a drive means which is forcibly controlled in the working cycle of the working piston 4 and which is preferably a compression spring 38,38', especially a leaf spring (FIGS. 1 and 3), which is fastened with one end to the outer sides, facing away from one another, of the plates 24, 24' and which lies with its other end on the free end of the piston rods 22,22'. When the auxiliary pistons 5,5' are in their bottom dead-center position, the leaf spring 38,38' is prestressed to the maximum and exerts a force in the direction of the top dead center of the auxiliary piston.

At the start of the working cycle, for example, the auxiliary piston 5' is in its bottom dead-center position, while the other auxiliary piston 5 assumes its top dead-center position (FIG. 1). The auxiliary piston 5' is locked in its bottom dead-center position by means of the toggle-lever arms 28',29', because these toggle-lever arms are in their extended position. Preferably, the toggle-lever arms 28',29' are over-extended a few degrees, so that bending of the toggle lever and, consequently, displacement of the auxiliary piston 5' in the direction of the top dead-center position is safely prevented. The other two toggle-lever arms 26',27' of the toggle lever 25' assume their angled position. The auxiliary piston 5' is loaded by the leaf spring 38' in the direction of its top dead-center position.

In the case of the other auxiliary piston 5, the toggle-lever arms 28,29 assume their angled position, while the other toggle-lever arms 26,27 are extended.

In FIG. 1, in the illustrated position of the two auxiliary pistons, 5,5', the working piston 4 is displaced in the direction of the cylinder head 8 so far that combustion of the mixture of air and fuel can take place at this end of the cylinder. The working piston 4 has such a length that, in this position, the outlet openings 20' in the combustion chamber 9' are released by the piston 4, so that the combustion gases can issue outwards through the outlet openings. As a result of the explosion pressure in the combustion chamber 9, the working piston 4 is now displaced out of the position shown in FIG. 1, in the direction of the arrow 39. In respect of the combustion chamber 9', the working piston 4 now executes the compression stroke. During this compression stroke, the combustion air which has flowed under pressure through the air outlet 14' into the combustion chamber 9' is pressed via the intermediate space 10' into the auxiliary chamber 11' and is compressed. The combustion chamber 9' and the auxiliary chamber 11' are matched to one another so that the volume ratio between combustion chamber and auxiliary chamber is approximately 6:1 to approximately 12:1. Consequently, when the working piston 4 assumes its top dead-center position in relation to the combustion chamber 9' (FIG. 2), the compression of the combustion air which is now located in the auxiliary chamber 11' is approximately six-fold to approximately twelve-fold. So that virtually all the combustion air which entered the combustion chamber 9' at the start of the working cycle can be pressed into the auxiliary chamber 11', the working piston 4 has, in its top dead-center position, only such a clearance from the cylinder head 8' that striking of the working piston against the cylinder head is prevented. The auxiliary piston 5' can, shortly before it even reaches the top dead center of the working piston 4, be released in the direction of its top dead-center position. Preferably, however, the auxiliary piston 5' is released only when the working piston 4 is already in its decompression phase again, that is to say, is displaced again in the direction of the cylinder head 8, opposite the direction 39. The compression stroke of the auxiliary piston 5' takes place approximately up to 45° after the top dead center of the working piston 4. So that the ignition pressure which arises during combustion can be transmitted in full to the crankshaft 7, the auxiliary piston 5' is, preferably, released only when the working piston 4 is located approximately 30° to approximately 45° after its top dead center, that is to say, is already in the decompression phase.

Since the auxiliary piston 5' is secured in its bottom dead-center position by means of the toggle-lever arms 28',29' which are in their extended position, the toggle-lever arms must be moved in the direction of their angled position. Provided for this purpose is a release mechanism 40,40' which is forcibly controlled by the crankshaft 7, in the working cycle of the working piston 4, via cams and/or levers. On the crankshaft 7 sits, for example, a cam (not shown), in the path of movement of which lies the free end of an arm of an angle-lever mounted on a pivot. The pivot axis lies parallel to the crankshaft, while the angle-lever is located in a plane perpendicular to this axis. When the cam of the crankshaft encounters the one arm of the angle-lever, the latter is swung aside, while the free end of the other arm of the angle-lever pushes against and pushes through the toggle-lever arms 28',29' which are in their extended position. The very strongly prestressed leaf spring 38' is then free, so that it moves the auxiliary piston 5' abruptly in the direction of its top dead center or in the direction of the cylinder head 8'. The force of the leaf spring 38' is greater than the maximum compression pressure of the combustion air in the auxiliary chamber 11', so that the auxiliary piston 5' is moved abruptly into its top dead-center position by the leaf spring 38' against the compression pressure of the combustion air. In so doing, the auxiliary piston 5' flies freely into its top-dead center position.

Before the auxiliary piston 5' is released in its bottom dead-center position, the working piston 4 is already in its decompression phase again, in respect of the combustion chamber 9', so that the combustion air which is very strongly compressed in the auxiliary chamber 11' can expand again slightly. As a result of the very high spring force and the resulting abrupt movement of the auxiliary piston 5' into the top dead-center position, the combustion air located in the auxiliary chamber 11', in the intermediate space 10' and in the combustion chamber 9' is compressed again so strongly that it has the compression pressure necessary for spontaneous ignition.

The stroke speed of the auxiliary piston 5' is so high, in comparison with the speed of the working piston 4, that this high compression pressure is achieved despite the working piston 4 which moves downwards. The upward stroke of the auxiliary piston 5' is limited by the toggle-lever arms 26',27' which determine the top dead-center position 5' by their extended position. The extension of the toggle-lever arms 26',27', and the bending of the other toggle-lever arms 28',29', is achieved due to the fact that the toggle-lever arms 27', 28' are mounted pivotably on the bearing pin 33' which sits firmly on the piston rod 22' via the adjusting ring 34'. As a result, the toggle levers are moved into their respective positions via the piston rod 22'.

In the top dead-center position, the auxiliary piston 5' has only so much clearance from the cylinder head 8' as is necessary to prevent the auxiliary piston from striking against the cylinder head. By means of this measure, it is ensured that, during the compression stroke, all the combustion air located in the auxiliary chamber 11' is pressed through the intermediate space 10' in the combustion chamber 9' of the working cylinder 1.

Simultaneously with the release of the auxiliary piston 5', fuel is introduced into the intermediate space 10' via the inlet nozzle 19'. The highly compressed combustion air which flows through the intermediate space 10' during the compression stroke of the auxiliary piston 5' entrains with it the fuel which emerges from the inlet nozzle 19' and which is atomized very finely in the stream of combustion air and enters the combustion chamber 9' together with the highly compressed air.

The spontaneous ignition of the highly compressed mixture of combustion air and fuel takes place even before the auxiliary piston 5' has reached its top dead-center position. Preferably, the mixture is already compressed to the compression pressure necessary for spontaneous ignition when the auxiliary piston 5' is approximately half the distance between the bottom and top dead-center positions. As a result, the spontaneous ignition of the mixture in the intermediate space 10' takes place even before the top dead center of the auxiliary piston is reached. During the further upward stroke, the highly compressed combustion air still located in the auxiliary chamber 11' is supplied to the combustion which has already taken place in the intermediate space 10' and in the combustion chamber 9' of the working cylinder 1, and is also pressed into the intermediate space 10', as a result of which a flashback of the combustion into the auxiliary chamber 11' is prevented. Moreover, as a result of the additional pressed-in combustion air, an intensive and strong turbulence of the mixture is obtained, so that the mixture is completely burnt. The turbulence and, consequently, the combustion of the mixture is assisted by the fact that the intermediate space 10' is widened out, preferably continuously, from the auxiliary chamber 11' in the direction of the combustion chamber 9', in the manner of a Venturi tube.

The ignition pressure which arises during combustion acts upon the piston end plate **4*a* of the working piston 4 and presses this counter to the direction of the arrow 39 in FIG. 1. During the return of the working piston 4, the combustion gases expand and pass into the open via the outlet openings 20' which are cleared, in a predetermined position, during the return of the working piston. Simultaneously with the clearance of the outlet openings, the valve 13' is opened via the above-described control, so that fresh combustion air enters the combustion chamber 9' through the air outlet 14', the combustion chamber, the intermediate space 10', and the auxiliary chamber 11'** being flushed.

During the return of the working piston 4 in the direction to the cylinder head 8 counter to the direction of the arrow 39, the auxiliary piston 5' is driven in the direction of its bottom dead-center position via a driver 41'. The driver 41' has an engaging piece 42' which is provided on the working piston 4 and which projects outwards through a slit 43' in the shell of the working cylinder 1. On the piston rod 22' of the auxiliary piston 5' is mounted a stop 44' which is preferably adjustable on the piston rod, so that its position relative to the engaging piece 42' can be set exactly. The stop 44' is, for example, a ring which can be displaced on the piston rod and which can be clamped on the piston rod, in the appropriate position, for example by means of a clamping screw. The stop 44' and the engaging piece 42' are adjusted relative to one another so that, when the working piston 4 moves against the direction of the arrow 39, the engaging piece 42' comes to rest against the stop 44' and thereby returns the auxiliary piston 5' in the direction of its bottom dead-center position. So that the toggle-lever arms 26',27' which are extended in the top dead-center position of the auxiliary piston 5' can be bent, there sits on the bearing part 30' a leg spring 45' which loads the toggle-lever arm 26' in the direction of its angled position. Consequently, as soon as the engaging piece 42' comes to rest against the stop 44' and tries to move the piston rod 22' against the direction of the arrow 39, the leg spring 45' presses the toggle-lever arm 26' in the direction of its angled position, so that the piston rod 22' and, consequently, the auxiliary piston 5' can be displaced. When the auxiliary piston 5' assumes its bottom dead-center position, the toggle-lever arms 28',29' are in their extended position, as a result of which the auxiliary piston is held firmly in its bottom dead-center position. When the piston rod 22' is pushed back, the leaf spring 38' is also tensioned again, and lies against the free end of the piston rod even in the top dead-center position.

When the auxiliary piston 5' assumes its bottom dead-center position, then the working piston 4 is also in its bottom dead-center position in respect of the combustion chamber 9'.

When the working piston 4 returns against the direction of the arrow 39, the precompression of the air which has flowed into the combustion chamber through the air outlet 14 now takes place in the combustion chamber 9 at the other end of the cylinder. When the working piston 4 assumes its top dead-center position in respect of the combustion chamber 9', the outlet openings 20 in the combustion chamber 9 are now free, so that the combustion gases can issue outwards in the way described above. During the reversal of movement of the working piston 4, that is to say, during the decompression stroke in respect of the combustion chamber 9', the outlet openings 20 are closed again, the valve 13 also being closed simultaneously via the force-control described above. When the working piston 4 is moved further against the direction of the arrow 39, there then occurs, in the way described above, the precompression of the combustion air which is pressed into the auxiliary chamber 11 via the intermediate space 10, and the spontaneous ignition of the mixture by means of the auxiliary piston 5 also occurs. Thus, when the auxiliary piston 5' assumes its top dead-center position, the other auxiliary piston 5 is in its bottom dead-center position, as illustrated in FIG. 2. As a result, one combustion operation takes place during each stroke of the working piston 4. For the retraction of the auxiliary piston 5, the working piston likewise has the driver 41 with the engaging piece 42 and the stop 44. Moreover, there likewise engages on the toggle-lever arm 26 a leg spring 45 which loads the toggle-lever arm in the direction of its angled position. The two auxiliary cylinders and the associated toggle-lever joints 25,25' are designed identically in each case.

As shown in FIG. 3, the internal-combustion engine has two working cylinders 1,1' while lie next to one another at the same height and which are each provided with the two auxiliary cylinders 2,2'. The two working cylinders are connected to one another by the plates 24,24' provided in the region of the two ends of the working cylinders. Fastened to the outer sides, facing away from one another, of the plates 24,24' are the leaf springs 38,38' which bear on the respective piston rods of the auxiliary cylinders 2,2' and which load these in the direction of their top dead-center position.

The two plates 24,24' also constitute a support for the crankshaft 7, which is located in the region below a plane containing the two cylinder axes. Moreover, the crankshaft 7 lies centrally in respect of the two working cylinders 1,1'. The crankshaft has two shaft parts 46,46' (FIG. 6) while lie at the same height and are parallel to the axis of the cylinders and which each have, at their ends facing one another, a flange 47,47' lying perpendicularly to them. The two flanges are connected to one another by means of a shaft intermediate piece 48 which lies at an acute angle to the shaft parts 46,46' and which has perpendicularly projecting flanges 49,49' at each of its two ends. The flanges 47,49 and 47',49' which lie adjacent to one another constitute the end faces of a part piece 50,50' of the crankshaft 7, said part piece having a wedgeshaped cross-section.

The sides of the flange 49,49' of the shaft intermediate piece 48 which face one another constitute bearing faces for a crank bearing 51 which is mounted rotatably on the shaft intermediate piece. The crank bearing 51 is made substantially cylindrical (FIG. 4) and has a through-bore 52 for the shaft intermediate piece 48. Provided in the shell surface of the crank bearing, approximately half-way along the crank bearing 51, is an annular depression 53 into which engage the crank arms 6,6' facing away from the working cylinder 1,1' (FIGS. 3 to 6). The one crank arm 6 is mounted pivotably in respect of the crank bearing 51, while the other crank arm 6' is connected fixedly to the crank bearing. This crank arm 6' is supported with a plate 54 on the shell surface of the crank bearing 51 and is fastened to this surface, for example, by means of screws.

The other crank arm 6 sits on a bearing pin 55 which is accommodated in a bore 56 lying parallel to the bore 52 and runs through the depression 53. The bearing pin 55 is mounted rotatably in bearing bushings 57,57' in the two crank-bearing parts lying on both sides of the depression 53 (FIG. 6). To prevent the bearing pin 55 from falling out, there is provided a securing pin 58 which lies transversely to the bearing pin and passes through the latter and which is mounted in the crank arm 6 in a bore 59 lying transversely to the axis of the bearing pin. The crank arms 6,6' bear on thrust plates 64,64' which bear, within the depression 53, on side walls of the latter and which prevent premature wear of these side walls. The other end of the two crank arms 6,6' has, in each case, a ball end 60,60' which is hinged in an appropriate ball-socket bearing 61,61' in the working piston 4.

When the crank shaft 7 rotates, the crank bearing 51 is not rotated with it, but the inclined shaft intermediate piece 48 rotates in the bore 52 of the crank bearing 51. As a result, the crank bearing executes a kind of wobbling movement which, as a result of the inclined position of the crank bearing, is converted via the crank arms 6,6' into a to-and-fro movement of the working piston 4. A turning of the crank bearing 51 is prevented by the crank arm 6' which is connected rigidly to it.

The ball-socket bearing 61 is provided at one end of a solid cylinder 62 (FIG. 6) which is accommodated in the working piston 4 and which, in turn, is mounted so that it can move axially in a bearing bushing 63. During the wobbling movement of the crank bearing 51, the crank arms 6,6' execute a to-and-fro movement which runs along part of an arc of a circle. This piece of an arc of a circle is the flatter, that is to say, approximates the more to a straight line, the longer the crank arms. As a result of this to-and-fro movement of the crank arms 6,6' which runs along a path in the form of an arc of a circle, the crank arm also moves transversely to the working piston 4. Since the ball end 60 is mounted in the displaceable cylinder 62, these movements directed transversely to the axis of the working piston 4 can be compensated perfectly, so that no signs of wear as a result of these transverse movements arise in the region of this ball-and-socket joint.

The intermediate walls 3 between the combustion chamber 9,9' and the auxiliary chamber 11,11' constitute a part of the wall of the working cylinder and of the auxiliary cylinder 2,2'. Provided in the walls of the cylinders and in the cylinder head 8,8' are cooling lines (not shown) through which flows a cooling medium such as water, in order to reduce the thermal stresses which occur during the running of the engine. As a result of the cooling, the intermediate wall 3 which is thermally stressed both from the working cylinder 1 and from the auxiliary cylinders 2,2' is cooled to such an extent that premature wear or damage to the intermediate wall is prevented.

Instead of the leaf springs 38,38' described, other forcibly controlled drive means can also be provided, for example rod linkages, hydraulic or pneumatic devices, and the like.

The present invention is, of course, in no way restricted to the specific disclosure of the specification and drawings, but also encompasses any modifications within the scope of the appended claims.

What I claim is:

1. An internal combustion engine, having an entire working cycle including combustion air therewith capable of being brought to a compression pressure and being suitable for various types of fuel and for single and dual piston operation, comprising in combination:

at least one working cylinder, which includes a shell provided with a combustion chamber and a working piston having a working cycle including bottom and top dead center therewith;

a crankshaft to which said working piston is operatively connected, said crankshaft including a bent section, which includes a crank bearing rotatably mounted on said bent section, and a crank arm connected to said working piston and to said crank bearing;

at least one auxiliary cylinder associated with each working cylinder and provided with a wall, each of said auxiliary cylinders including an auxiliary chamber and an auxiliary piston which has a piston rod and a working cycle including a decompression phase and a compression stroke as well as having bottom and top dead center positions in which said top and bottom dead center positions of said auxiliary piston are determined by at least one stop device and which moves back and forth and is forcibly controlled in the working cycle of said working piston in which the compression stroke takes place up to approximately 45° after top dead center of said working piston wherein said auxiliary piston compresses the combustion air to the compression pressure necessary for spontaneous ignition just prior to completion of the compression stroke, the combustion chamber and the auxiliary chamber having a volume ratio of approximately 6:1 to approximately 12:1 as to each other;

said working piston being provided with an engaging piece with which a stop on the piston rod of said auxiliary piston coacts so that during at least part of the decompression phase thereof, said working piston drives said auxiliary piston;

an intermediate space connecting each auxiliary chamber with an associated combustion chamber in which said intermediate space widens out from said auxiliary chamber toward said combustion chamber like a Venturi tube, each auxiliary chamber being in constant open communication with its associated combustion chamber via said intermediate space during the entire working cycle of said engine;

an inlet nozzle for each of said combustion chambers for supplying fuel thereto, each inlet nozzle opening into an associated intermediate space and being controlled in the working cycle of said auxiliary piston, and wherein during the return in the decompression phase, said auxiliary piston is forcibly controlled by said working piston and, during the compression stroke, is moved by means of action of a spring acting on said auxiliary piston which is greater than the maximum compression pressure.

2. An engine in combination according to claim 1, in which said auxiliary piston effects said compression when it is approximately half-way between its bottom and top dead-center positions.

3. An engine in combination according to claim 1, in which said at least one working cylinder includes a cylinder head, and in the top dead-center position, at least one of said working piston and said auxiliary piston have only that clearance from said cylinder head which is necessary to prevent striking it.

4. An engine in combination according to claim 1, in which said at least one stop device is a toggle lever.

5. An engine in combination according to claim 1, in which said auxiliary cylinder is arranged with its axis parallel to that of said working cylinder.

6. An engine in combination according to claim 1, in which a part of said wall of said auxiliary cylinder constitutes a part of said shell of said working cylinder.

7. An engine in combination according to claim 6, in which said working cylinder and said auxiliary cylinder have a common housing.

8. An engine in combination according to claim 1, in which said crank arm is held in said crank bearing by means of a bearing pin.

9. An engine in combination according to claim 8, in which said bearing pin is accommodated rotatably in said crank bearing.

10. An engine in combination according to claim 9, in which said crank arm engages into a depression in said crank bearing.

11. An engine in combination according to claim 10, in which said crank arm is connected to said working piston via a ball end.

12. An engine in combination according to claim 11, in which said ball end is mounted in a revolute manner in a cylinder which is mounted in said working piston in such a way that it can move transversely to the axis of said working piston.

13. An engine in combination according to claim 12, in which each working cylinder includes two combustion chambers, in which said working piston has at each of its two ends a piston end plate for a respective combustion chamber, and in which each auxiliary cylinder and auxiliary piston therewith is assigned to each combustion chamber.

* * * * *